US006712039B2

(12) United States Patent
Hallam

(10) Patent No.: US 6,712,039 B2
(45) Date of Patent: Mar. 30, 2004

(54) INTERNAL COMBUSTION ENGINES

(75) Inventor: Paul W. Hallam, Vic (AU)

(73) Assignee: Ecoforce PTY LTD, Modewarre (AU)

( * ) Notice: Subject to any disclaimer, the term of this patent is extended or adjusted under 35 U.S.C. 154(b) by 0 days.

(21) Appl. No.: 10/168,988

(22) PCT Filed: Dec. 29, 2000

(86) PCT No.: PCT/AU00/01604

§ 371 (c)(1),
(2), (4) Date: Sep. 23, 2002

(87) PCT Pub. No.: WO01/49997

PCT Pub. Date: Jul. 12, 2001

(65) Prior Publication Data

US 2003/0075144 A1 Apr. 24, 2003

(30) Foreign Application Priority Data

Dec. 30, 1999 (AU) ..... PQ 4910

(51) Int. Cl.[7] ..... F02B 75/02
(52) U.S. Cl. ..... 123/317
(58) Field of Search ..... 123/317

(56) References Cited

U.S. PATENT DOCUMENTS 4,592,313 A 6/1986 Speckhart

FOREIGN PATENT DOCUMENTS

| | | |
|---|---|---|
| DE | 33 15 853 A1 | 10/1984 |
| DE | 38 08 542 A1 | 10/1988 |
| DE | 42 26 925 A1 | 2/1994 |
| EP | 0 631 040 A1 | 12/1994 |
| GB | 2 069 041 | 8/1981 |
| GB | 2 114 218 | 8/1983 |
| RU | 2076931 C1 | 11/1993 |

*Primary Examiner*—Noah P. Kamen
(74) *Attorney, Agent, or Firm*—Stites & Harbison PLLC; Douglas E. Jackson

(57) ABSTRACT

An internal combustion engine comprising at least one pair of pistons (20, 21) rotating, oscillating or reciprocating in cylinder assemblies (11, 12) joined by a crankcase (13), each piston (20, 21) being driven by a crankshaft housed in the crankcase (13), the crankcase (13) including an inlet port (63) for entry of an air fuel mixture and an outlet port (65) for transfer of compressed air fuel mixture, each cylinder (11, 12) having a combustion chamber (35) and at least one inlet (36) and at least one exhaust (36) valve port communicating with the combustion chamber (35), the inlet valve port (36) being in communication with the crankcase (13) via the crankcase outlet port (65) whereby the engine is adapted to run on a four stroke cycle with the underside of the piston (20, 21) pressurising the air fuel mixture in the crankcase (13) and causing transfer of the pressurised air fuel mixture to the combustion chamber (35) via the crankcase outlet port (65) and inlet valve port (36).

12 Claims, 15 Drawing Sheets

FIG. 3.
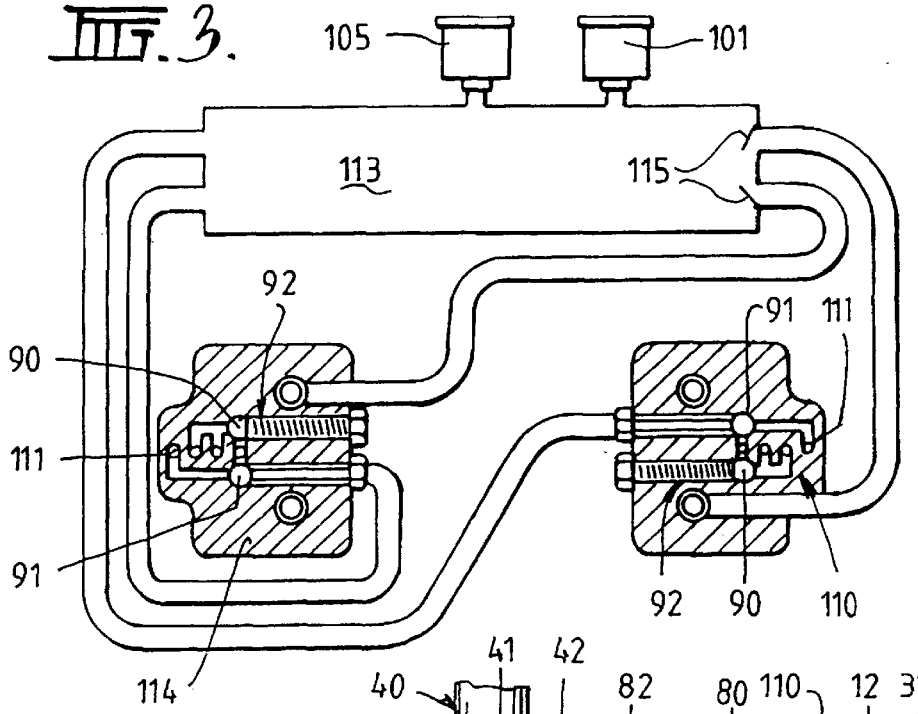
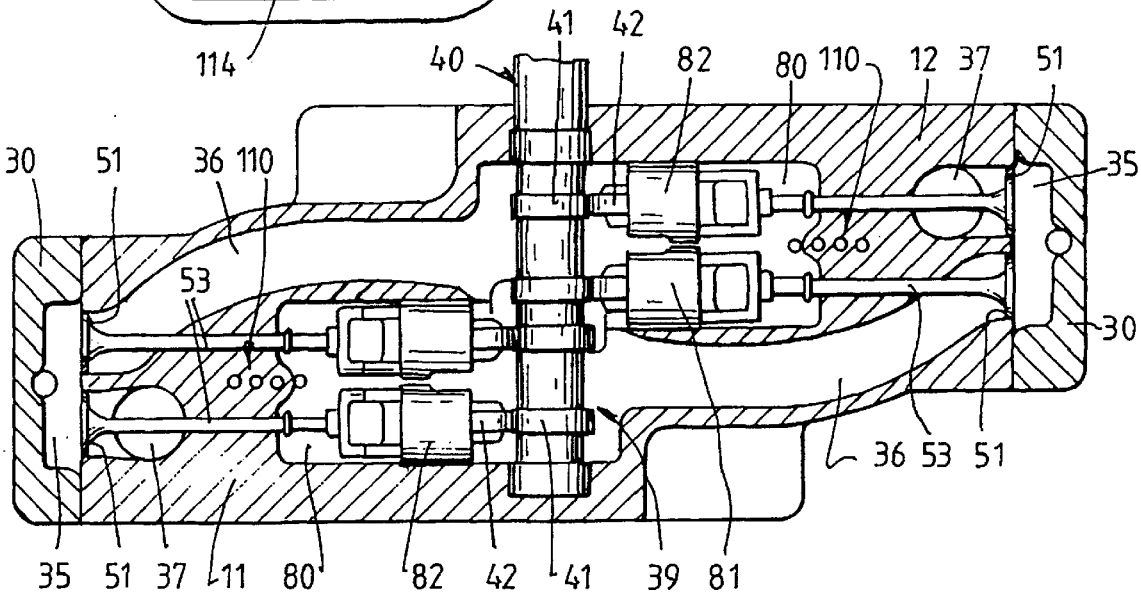
FIG. 2.

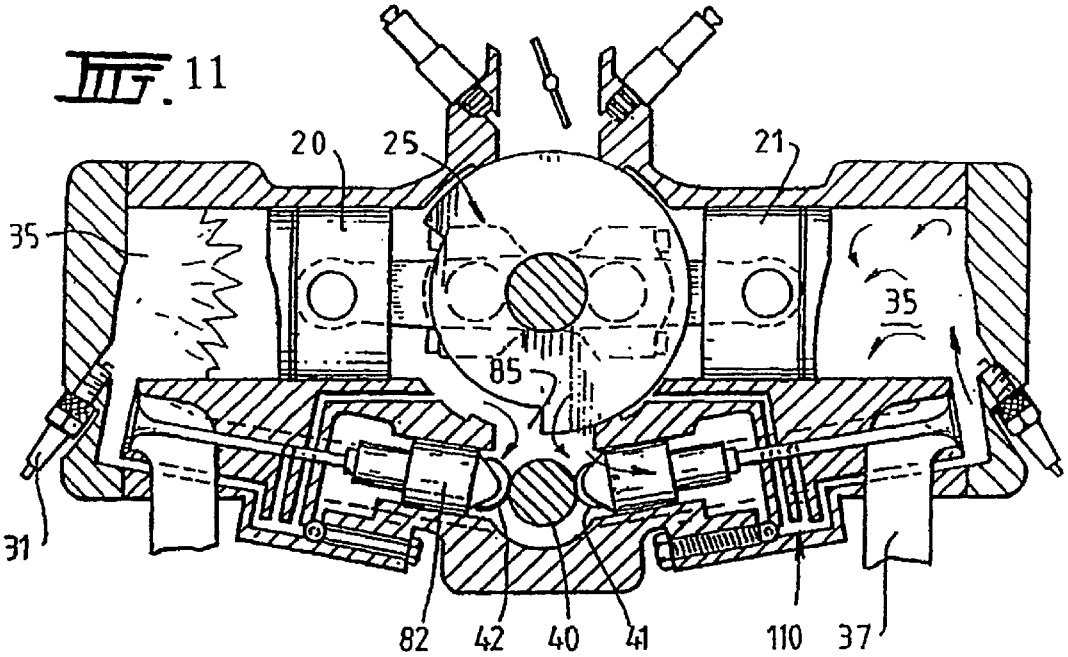
FIG. 11
20
25
21
35
35
85
31
82
42
40
41
110
37
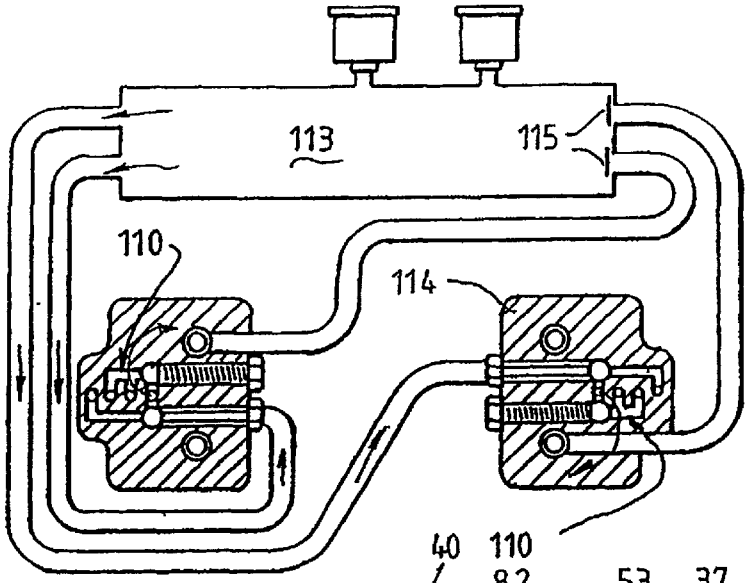
113
115
110
114
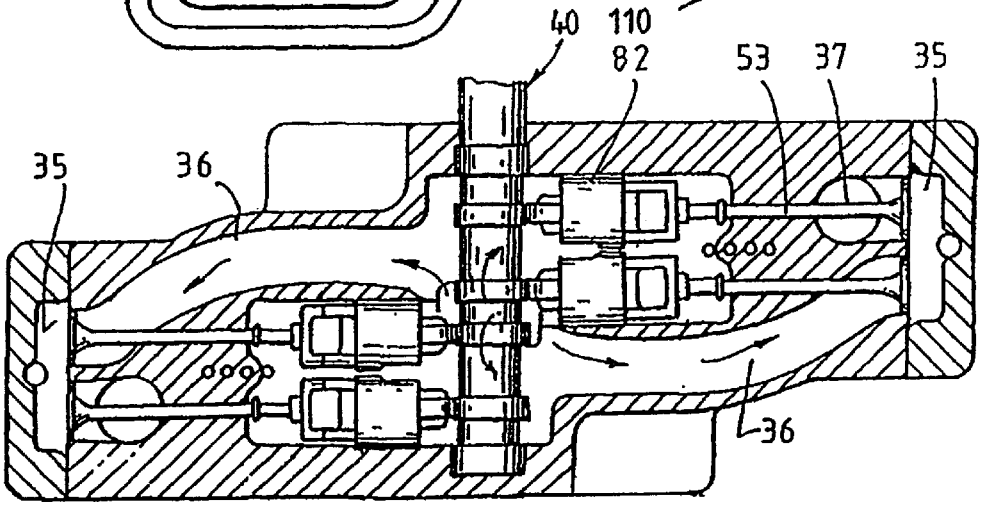
40
110
82
53
37
35
35
36
36

INTERNAL COMBUSTION ENGINES

This invention relates to internal combustion engines and particularly internal combustion engines that run on a four stroke cycle.

DISCUSSION OF THE PRIOR ART

The majority of internal combustion engines used in motor cars, trucks and motorcycles operate on a four stroke cycle. The four stroke cycle internal combustion engine has been in use for the bulk of the $20^{th}$ century. Over the years engine designers have constantly strived to improve the efficiency of such engines. In modern times these improvements in efficiency have dictated a need to also consider the environmental effects of the engine namely the production of pollutants including noxious gases that escape through the exhaust. Compromises have been reached in which the overall efficiency of the engine has been reduced by the need to introduce power absorbing equipment to purify the exhaust gases such as catalytic converters. Environmental issues have also dictated controls on fuels, consequently the addition of lead as an anti-knocking agent in high compression internal combustion engines has been phased out with the introduction of lead-free petrol resulting in further compromises in engine design.

Four stroke engines usually include at least one inlet and one exhaust valve per cylinder. In some small sophisticated engines pluralities of exhaust and inlet valves may be provided per cylinder. The valves are usually driven to an open position by the lobes of a camshaft. This drive can either be direct or indirect. The valves usually return to the closed position by the use of metal coil springs that simply urge the valve once open, back to the closed position. The size of spring force of the coil spring is designed to accommodate the engine when the largest demand is placed on the springs which is usually when the engine is running at the highest revolutions per minute (RPM). Thus, the valve springs have to be of sufficient size, weight and spring ratio to operate efficiently at the highest RPM. This means that at lower RPM the valve springs are too strong and thus unnecessary work is done against the springs causing a dramatic reduction in the engine efficiency in its normal operation range. Valve springs also have to be compressed during the starting procedure thus increasing the power required to turn over an engine to start it requiring large lead acid batteries and charging systems.

For many years it has been known that the combustion process can be improved by supercharging the incoming air fuel mixture, however superchargers consume energy and in turn reduce the efficiency of the engine. Most four stroke engines have reciprocating pistons, the crowns of which compress air/fuel mixture in a cylinder head for explosion and thus expansion. The reciprocating motion of the piston is not usually designed in a four stroke engine to pressurise the crankcase, though there have, in the past, been proposals to utilise the downward stroke of the piston to cause pressurisation of the crankcase to improve the efficiency of the engine.

It is these considerations and the many problems discussed above that have brought about the present invention.

SUMMARY OF THE INVENTION

According to the present invention there is provided an internal combustion engine comprising at least one pair of pistons rotating, oscillating or reciprocating in cylinder assemblies joined by a crankcase, each piston being driven by a crankshaft housed in the crankcase, the crankcase including an inlet port for entry of an air fuel mixture and an outlet port for transfer of compressed air fuel mixture, each cylinder having a combustion chamber and at least one inlet and at least one exhaust valve port communicating with the combustion chamber, the inlet valve port being in communication with the crankcase via the crankcase outlet port, the crankshaft including a rotary valve that opens and closes the crankcase inlet and outlet ports as the crankshaft rotates, whereby the engine is adapted to run on a four stroke cycle with the underside of the piston pressurising the air fuel mixture in the crankcase and causing transfer of the pressurised air fuel mixture to the combustion chamber via the crankcase outlet port and inlet valve port.

DESCRIPTION OF THE DRAWINGS

Embodiments of the present invention will now be described by way of example only and with reference to the accompanying drawings in which:

FIG. 2 is a schematic underside view of the engine shown in FIG. 1;

FIG. 3 is a schematic illustration of the gas valve control mechanism,

DESCRIPTION OF THE PREFERRED EMBODIMENT

Figure 1:
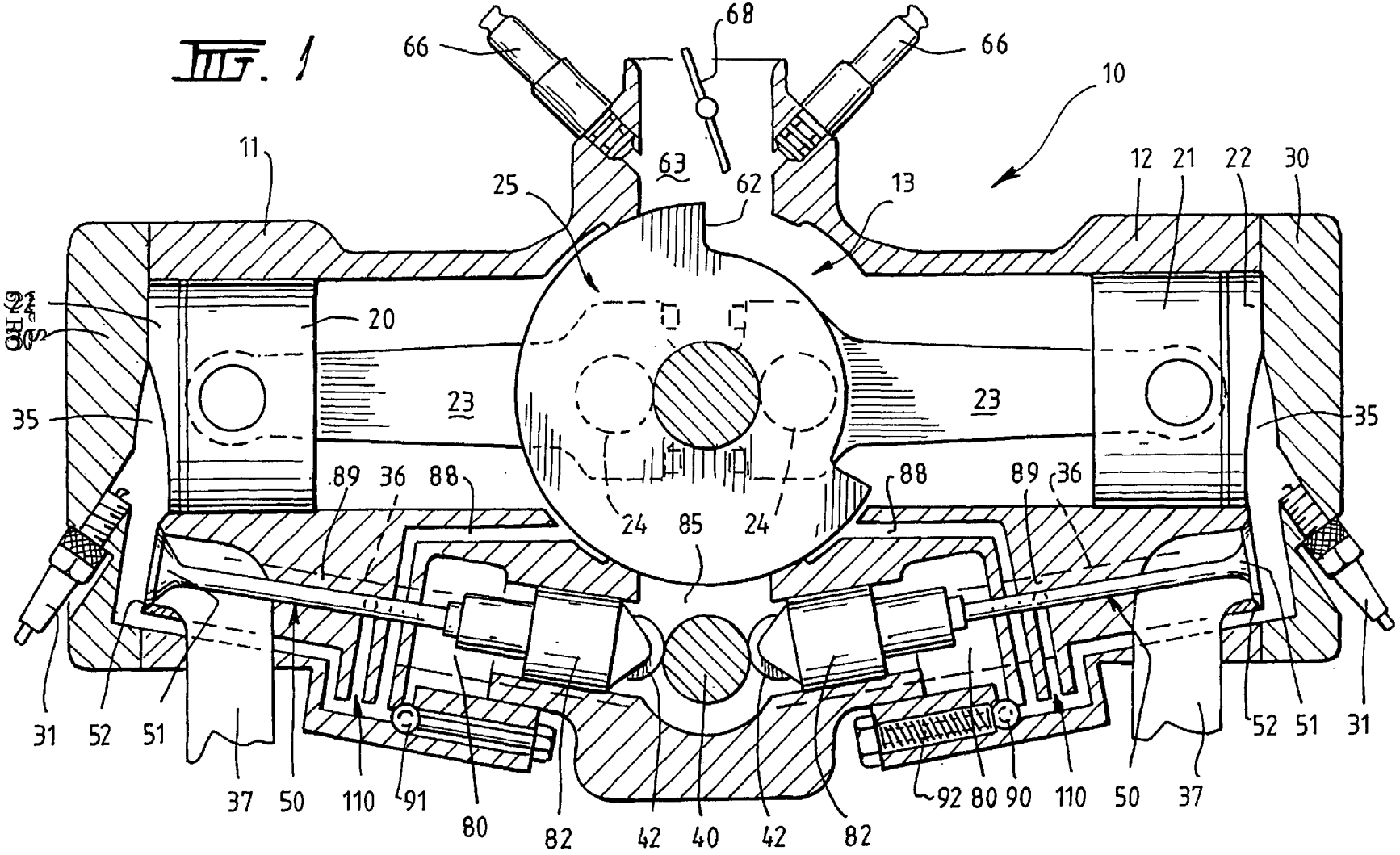
FIG. 1 is a schematic end on view of an engine in accordance with the invention.
Figure 4:
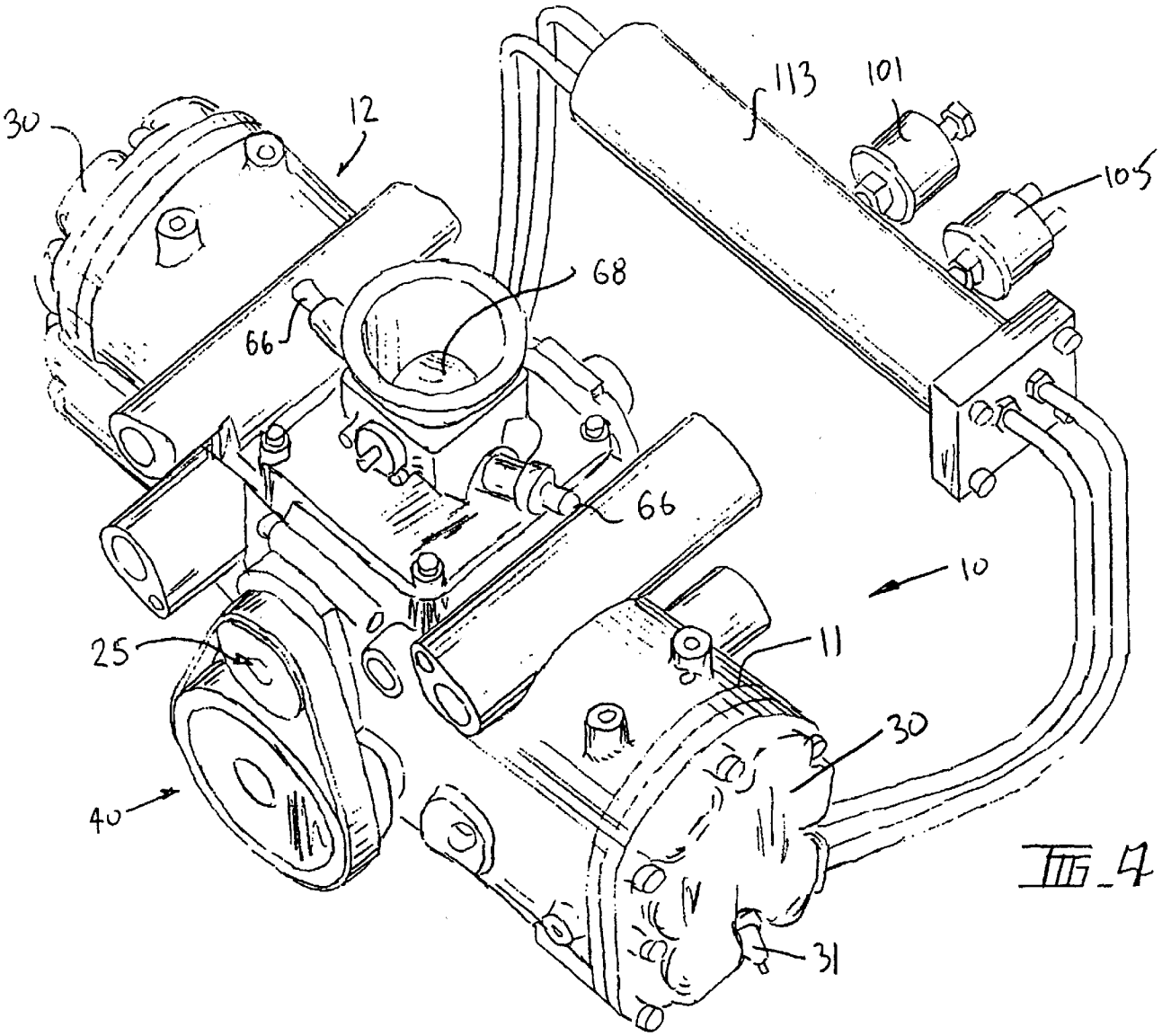
FIG. 4 is a perspective view of the engine from the top.
Figure 5:
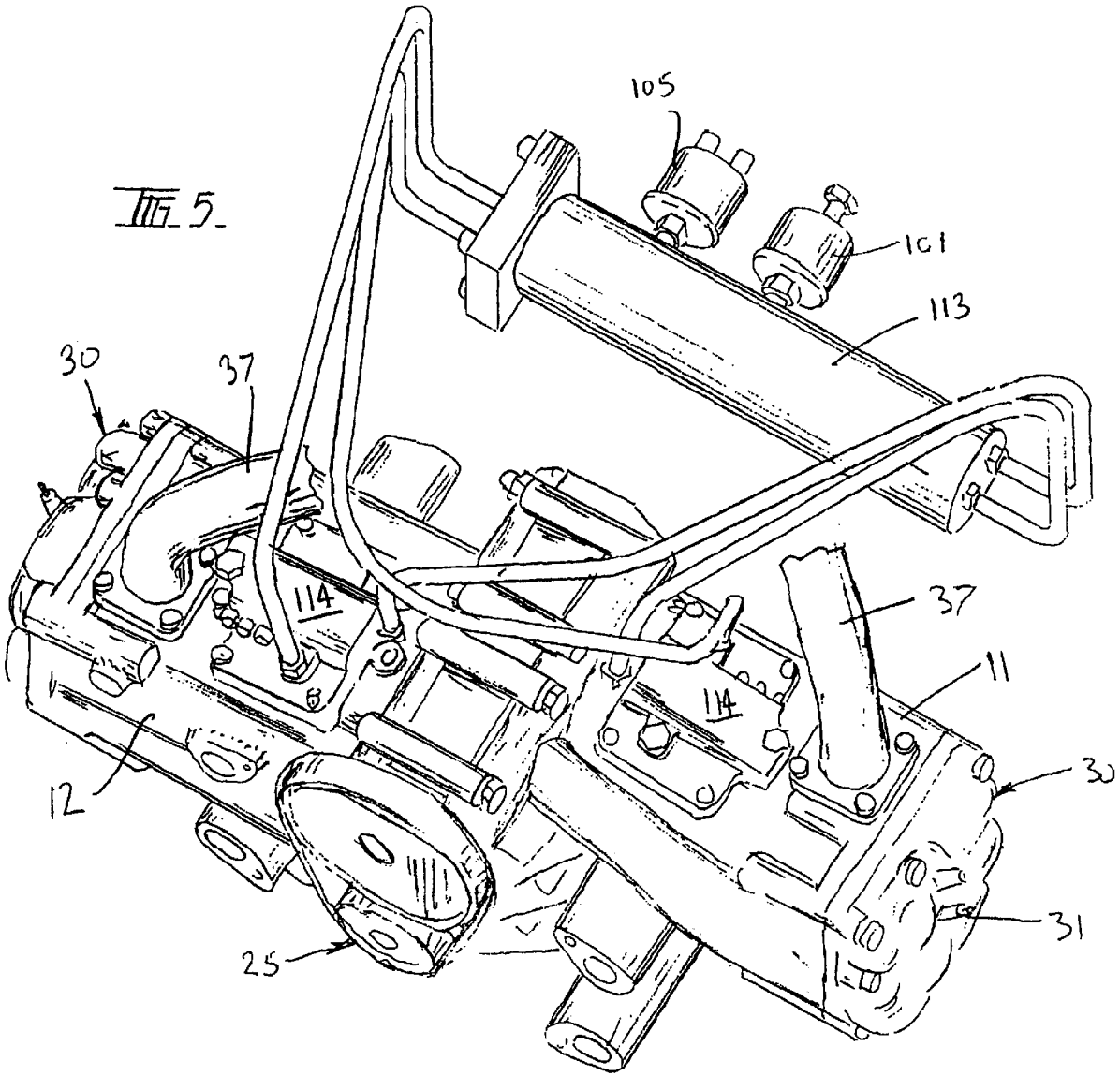
FIG. 5 is a perspective view of the engine from the bottom.
Figure 6:
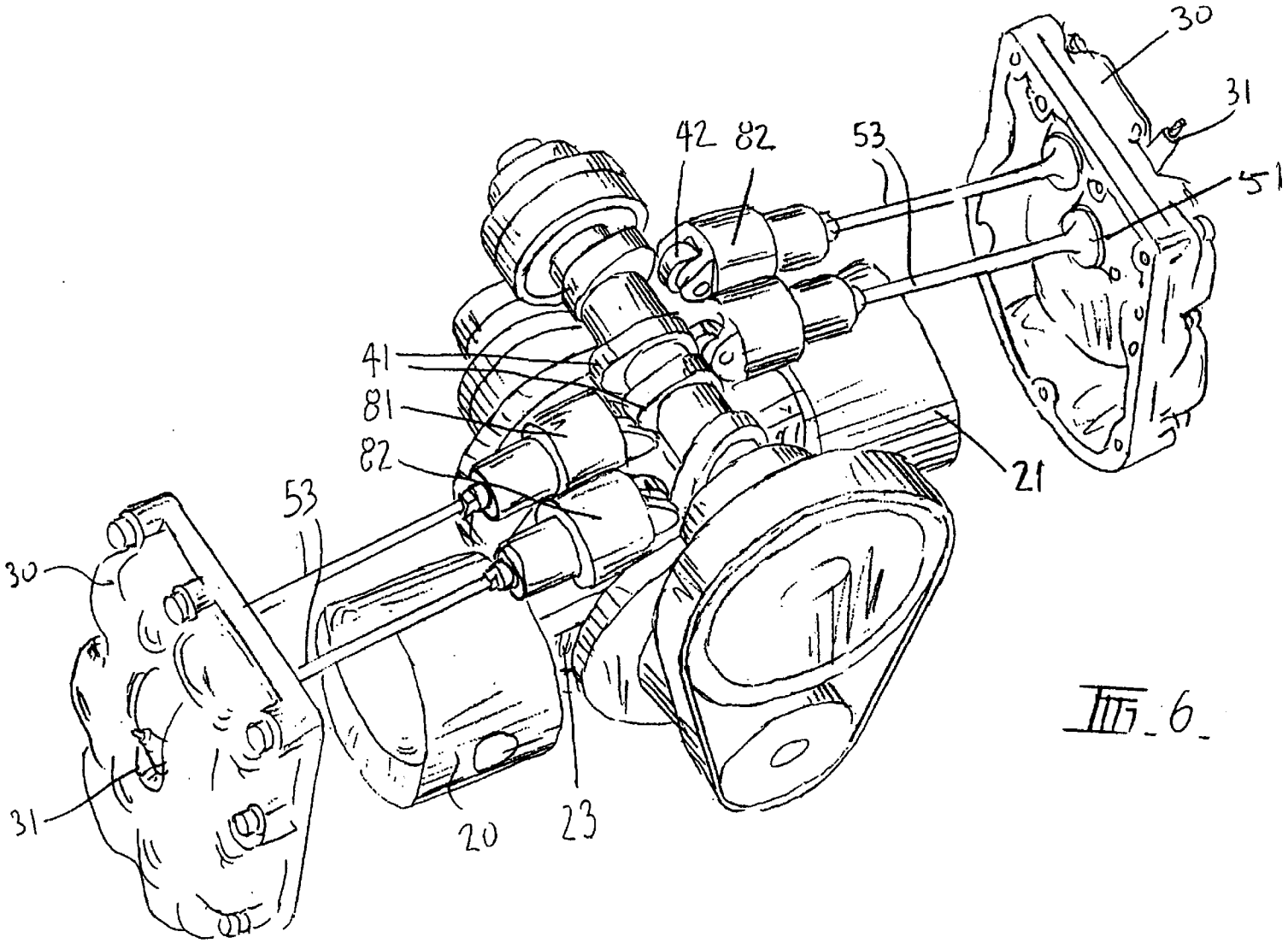
FIG. 6 is a perspective view of the engine with the crankcase and cylinder walls removed.
Figure 7:
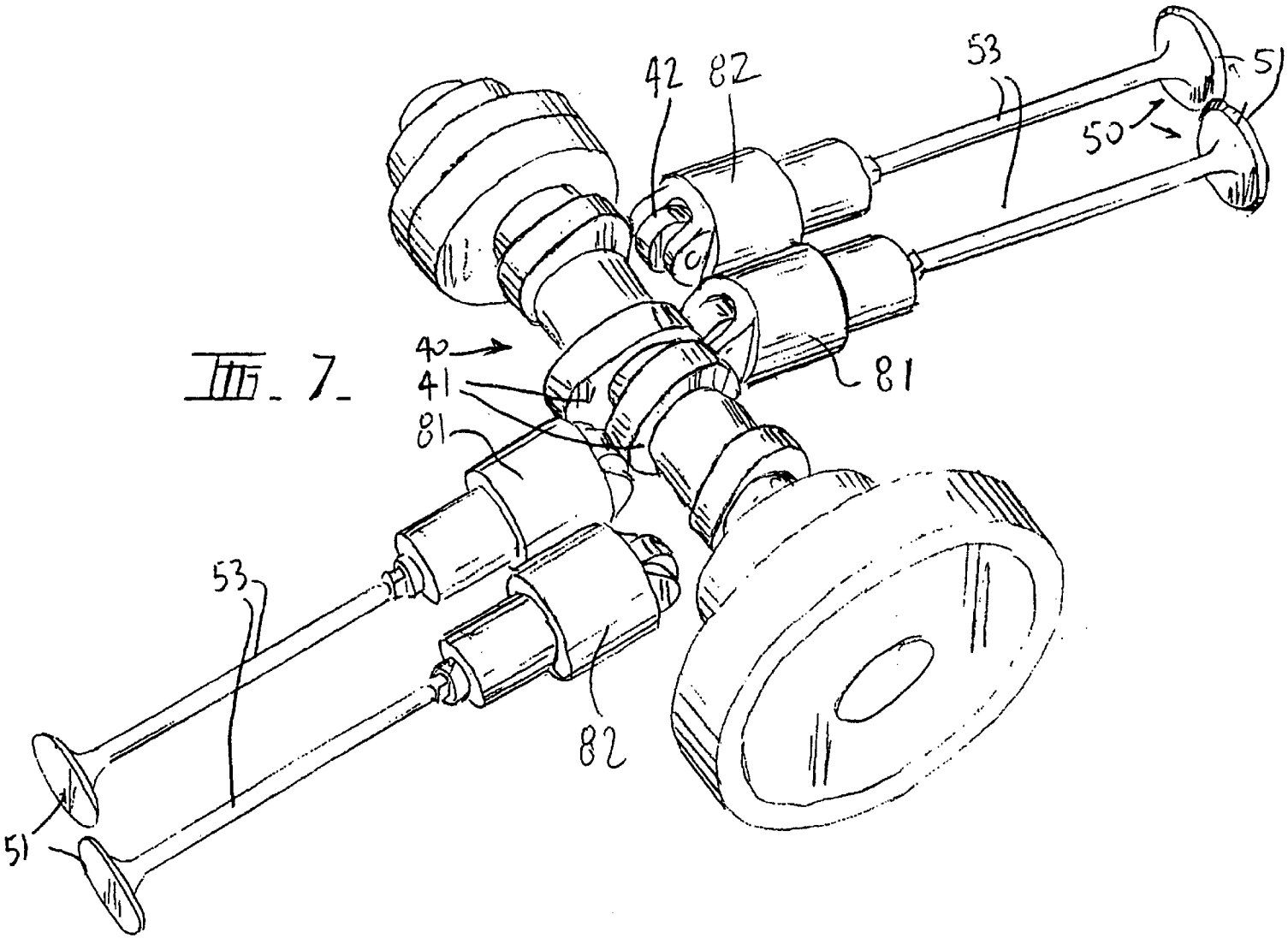
FIG. 7 is a perspective view of the camshaft and valve assemblies, and FIGS. 8 to 16 comprise views of FIGS. 1 to 3 illustrating the whole four stroke cycle of the engine.
Figure 8:
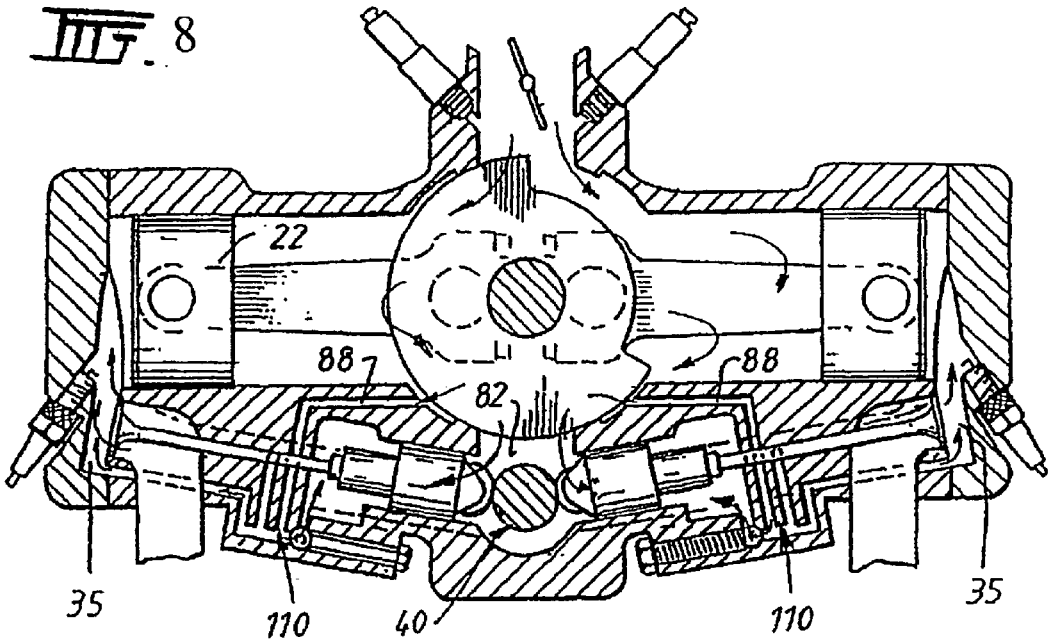
Figure 8:
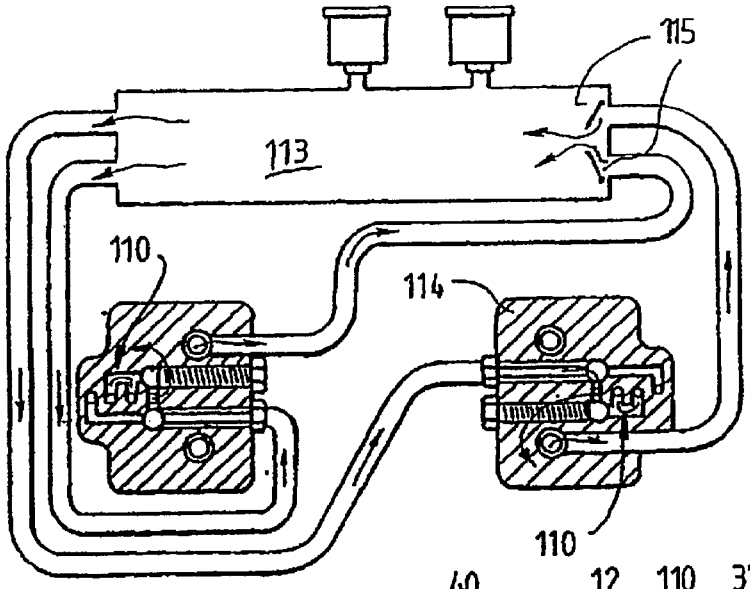
Figure 8:
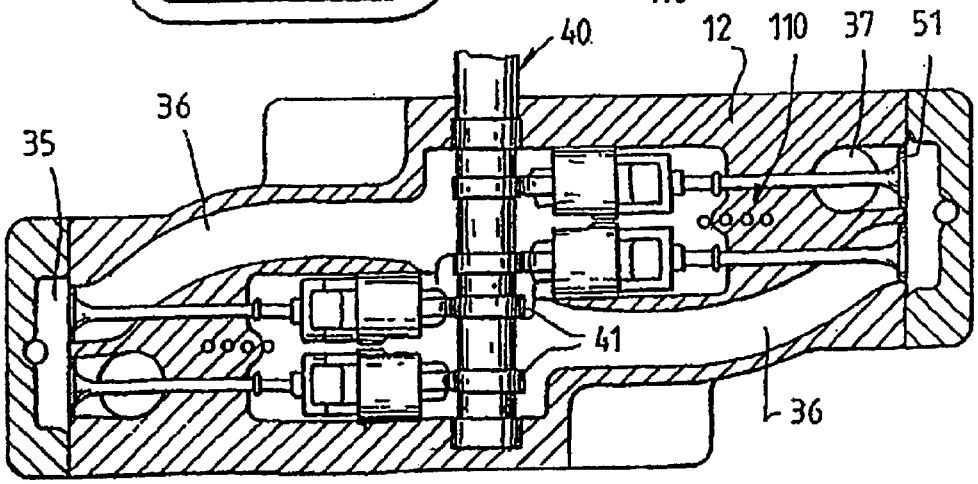
Figure 9:
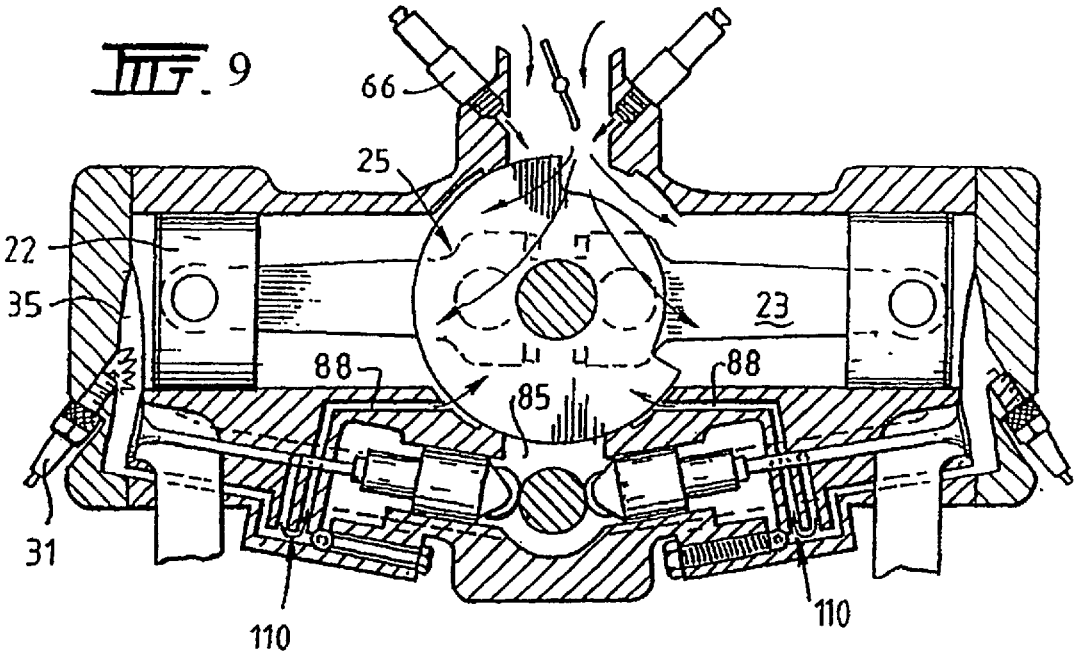
Figure 9:
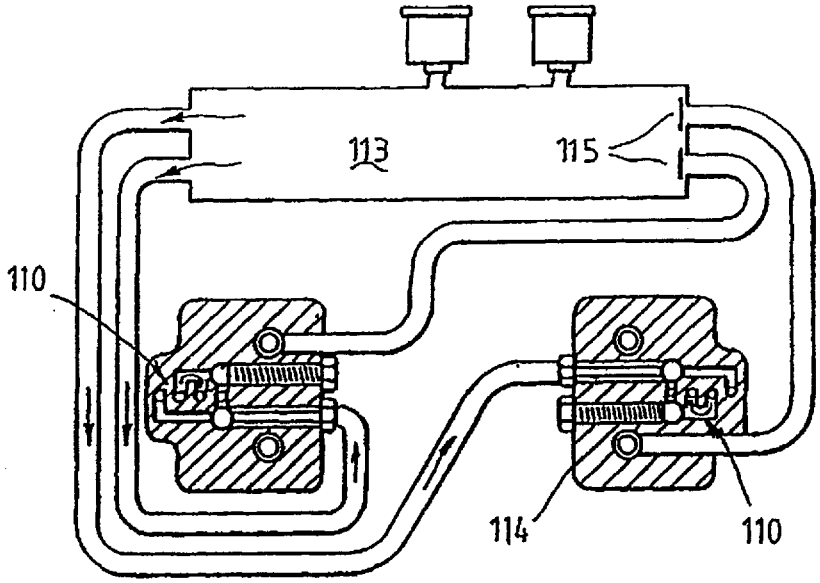
Figure 9:
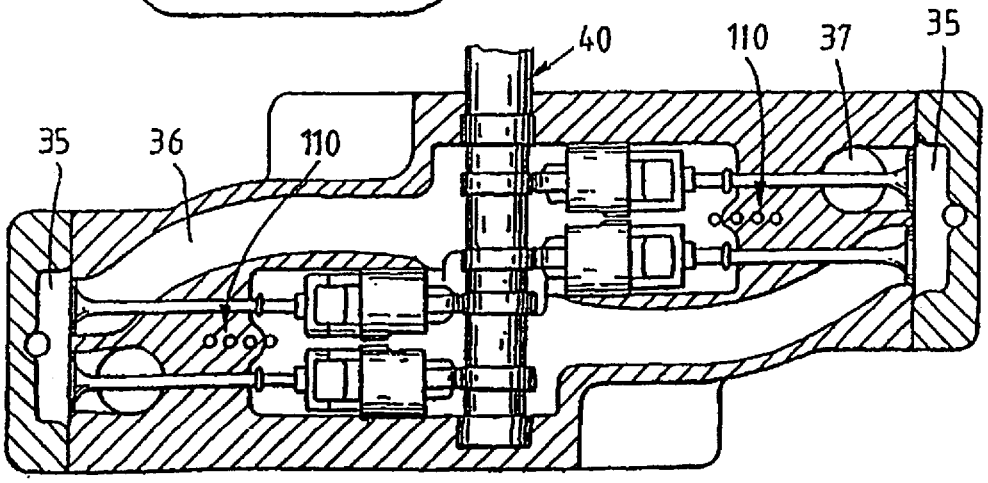
Figure 10:
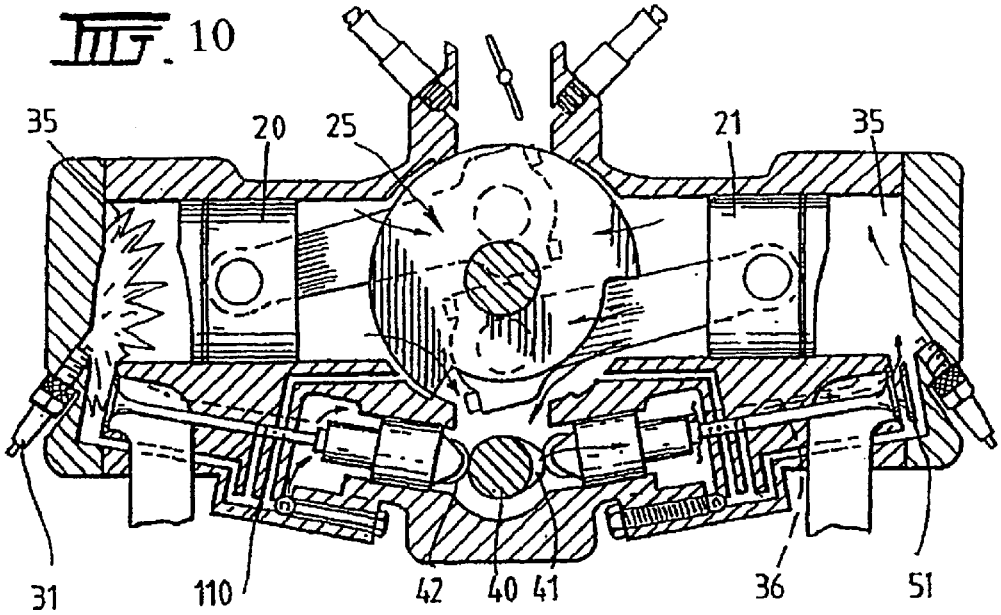
Figure 10:
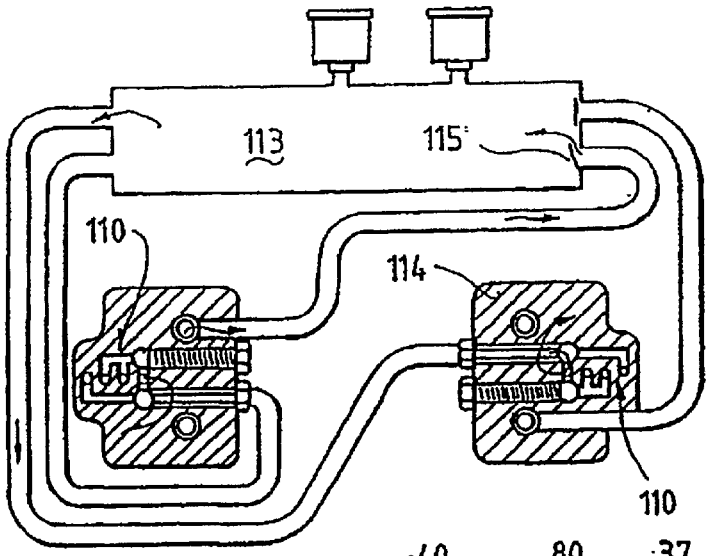
Figure 10:
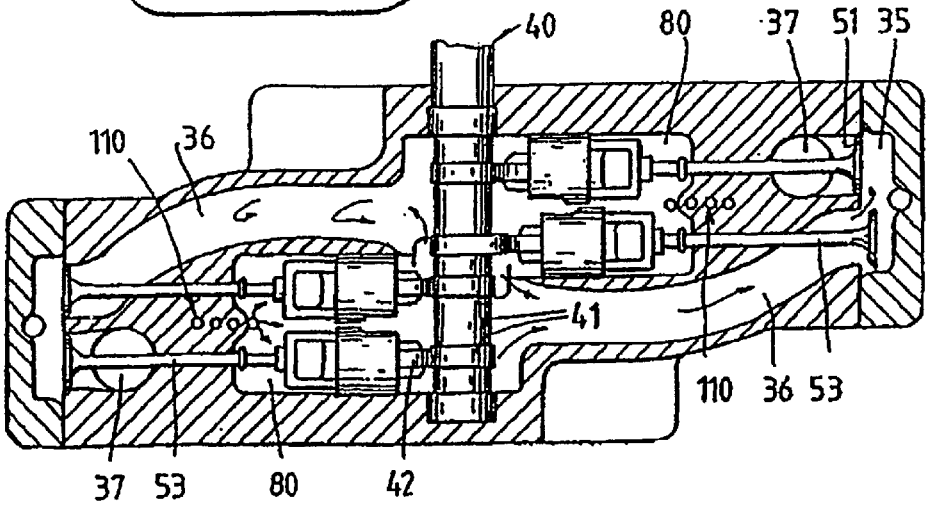
Figure 12:
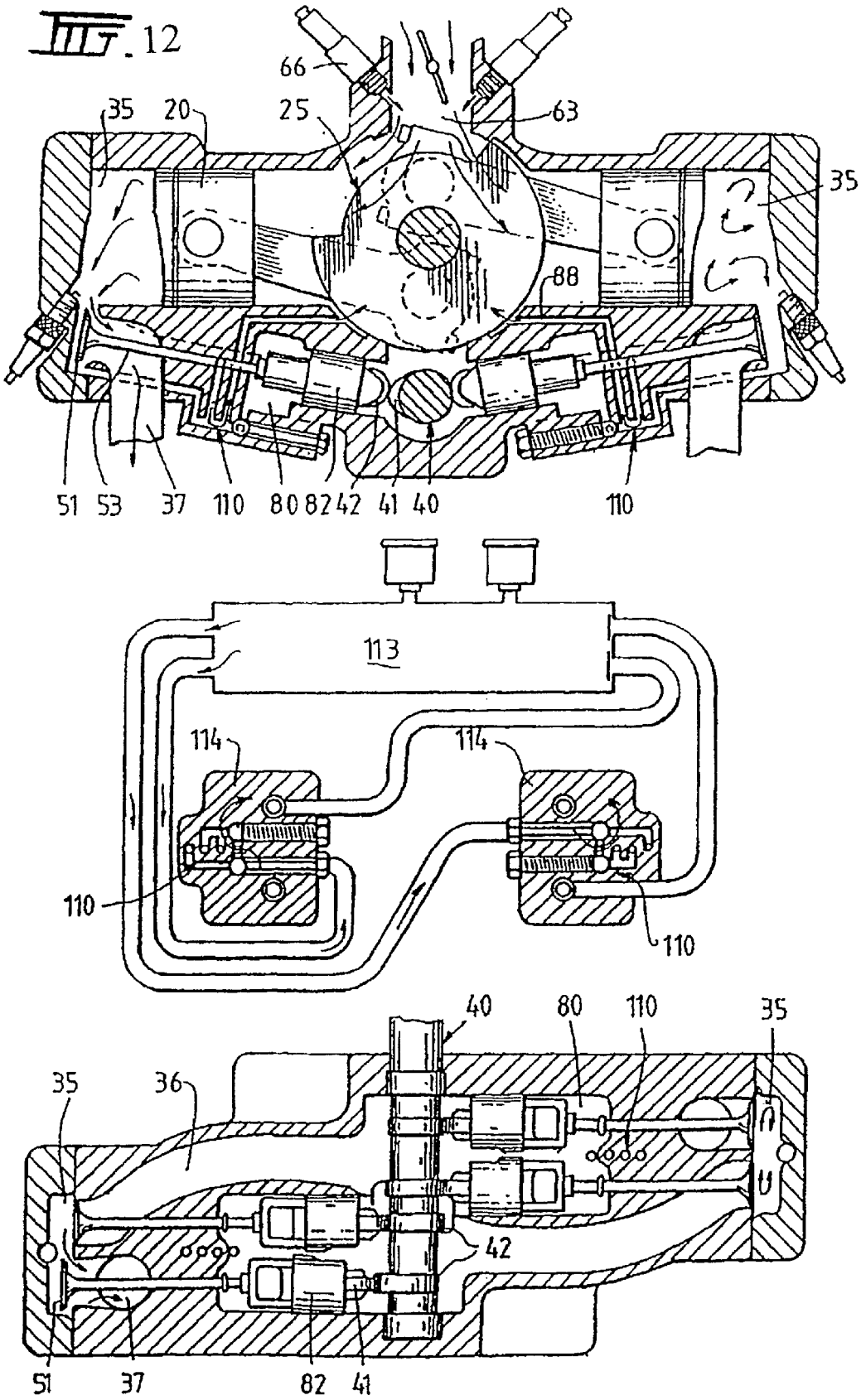
Figure 13:
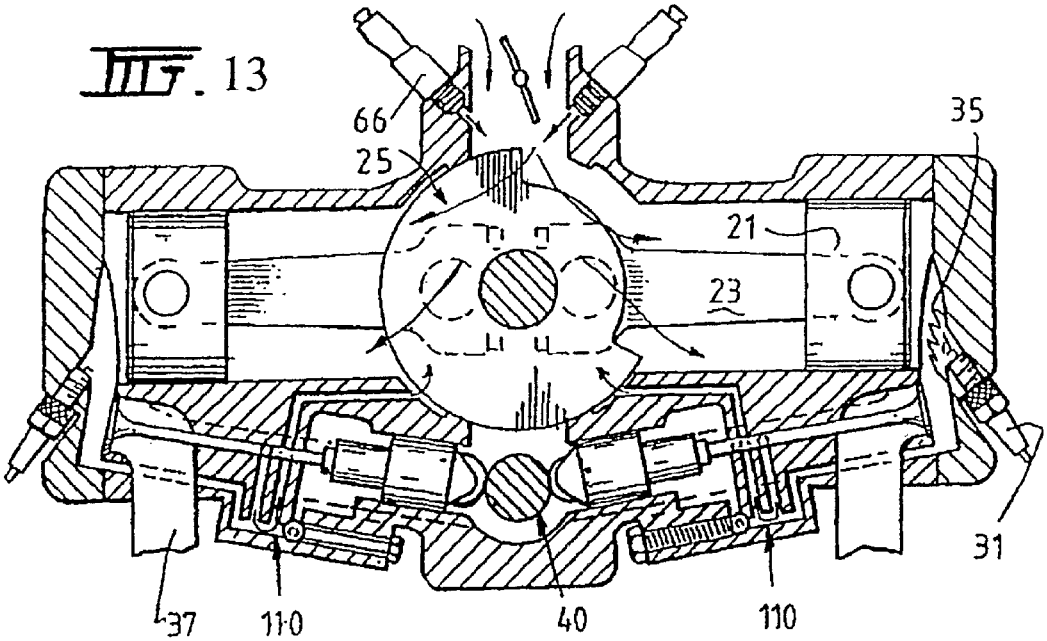
Figure 13:
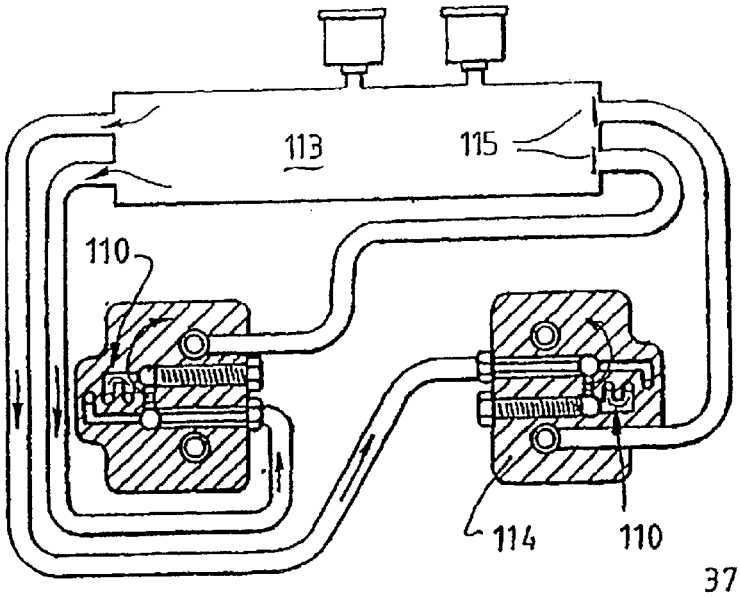
Figure 13:
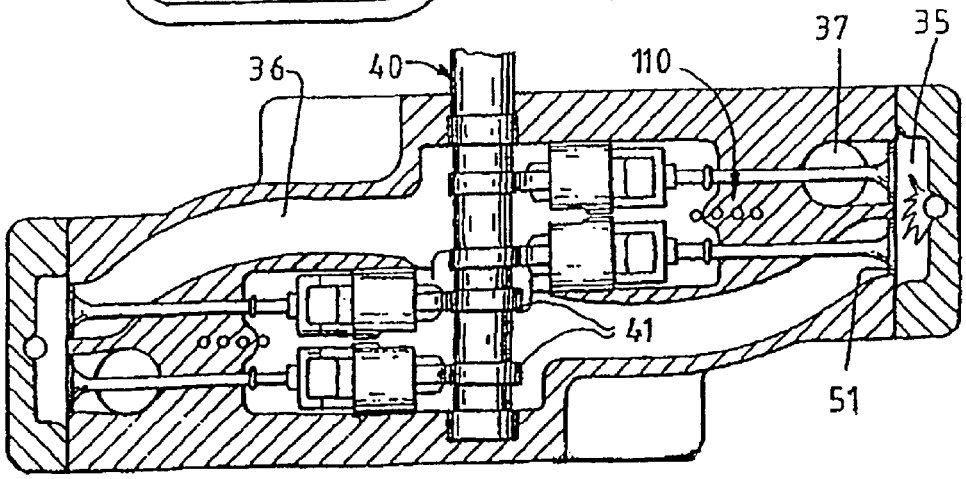
Figure 14:
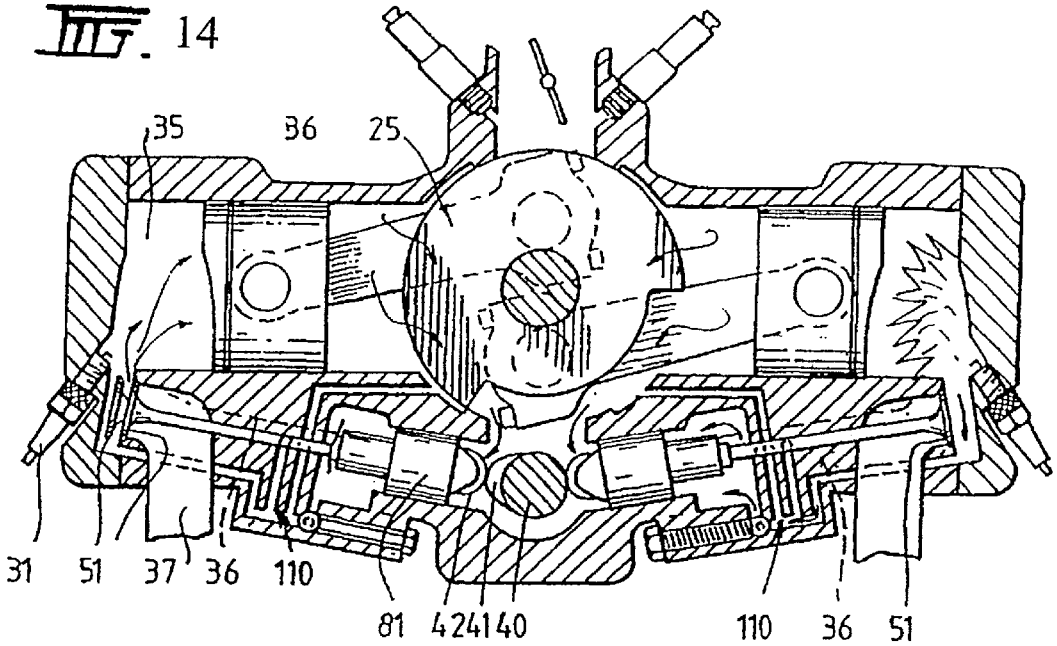
Figure 14:
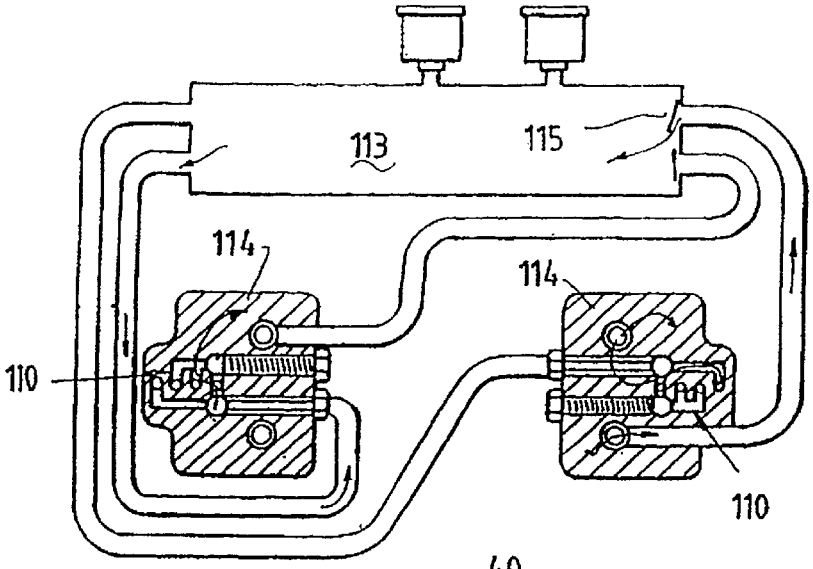
Figure 14:
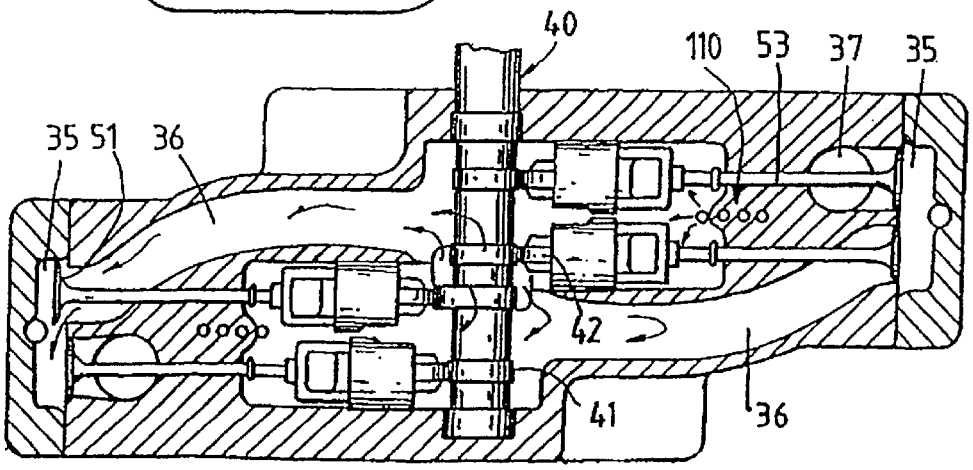
Figure 15:
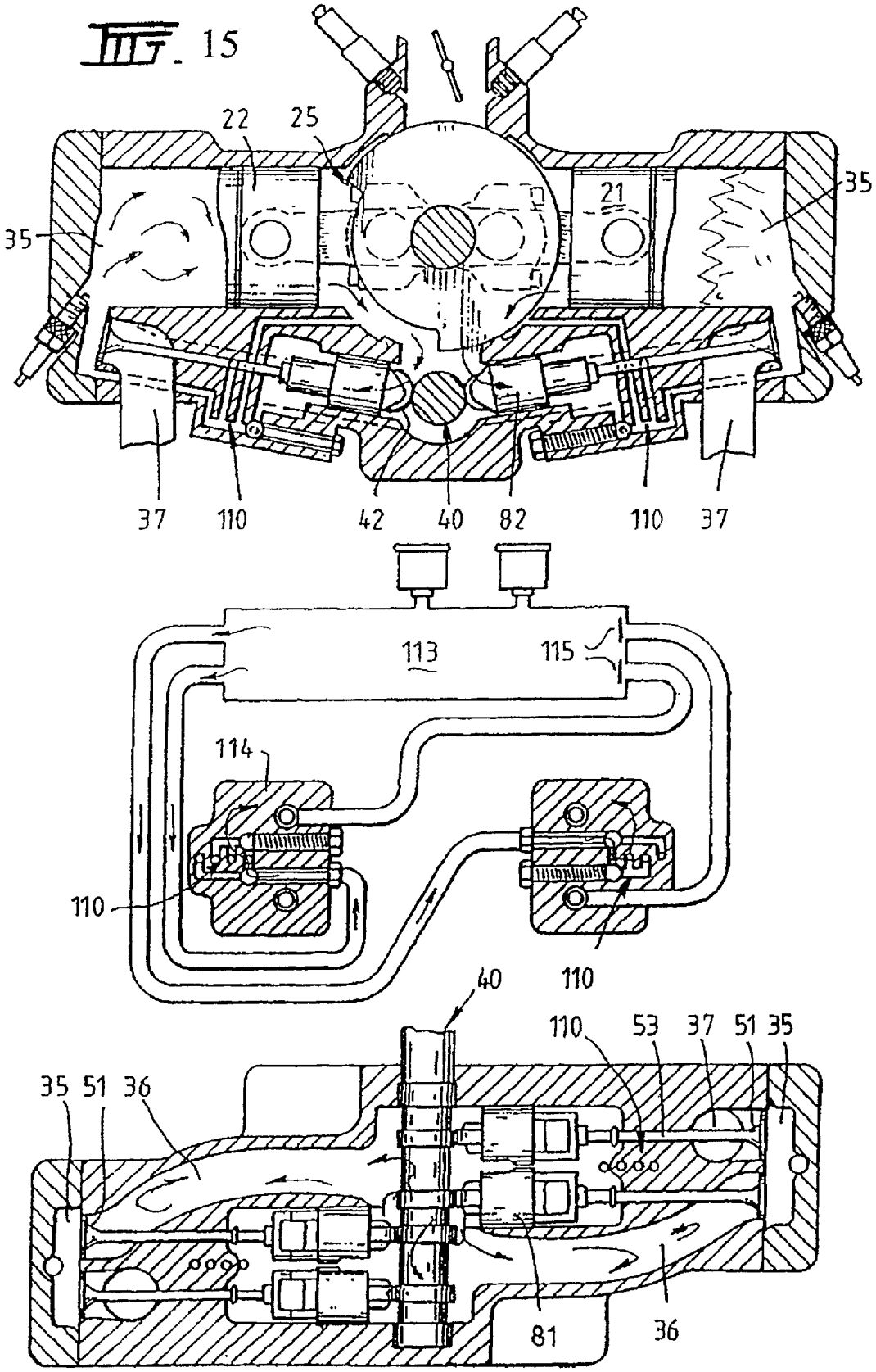
Figure 16:
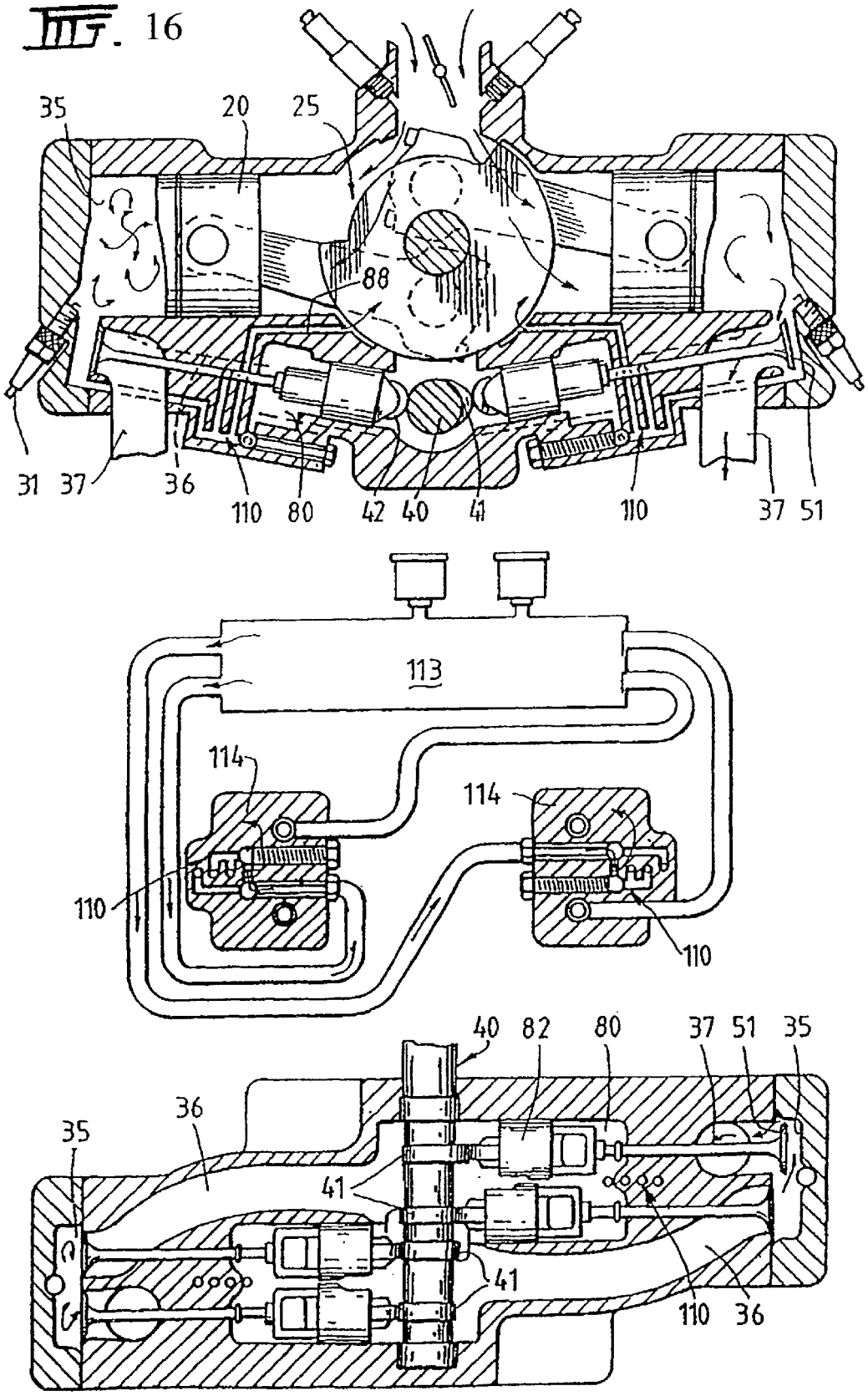

FIGS. 8–15 each utilize FIGS. 1 to 3 to illustrate the whole four stroke cycle of the engine. In particular, FIGS. 9–16 shows FIGS. 1 to 3 at 90° intervals through the four stroke cycle of 720°, while FIG. 8 shows a 'starting cycle" to illustrate a start-up cycle of the engine.

The drawings illustrate the engine schematically to illustrate the method of operation. It is understood that the actual engine could be considerably different in structural detail and it is envisaged that those skilled in this art would appreciate and understand the additional detail that would be required to put the schematic illustration of the engine into practical effect.

The drawings of the preferred embodiment illustrate an engine in the form of a horizontally opposed flat twin configuration. The engine 10 comprises cylinders 11 and 12 that extend radially outwardly from a central crankcase 13. The crankcase 13 houses a crankshaft 25 that supports reciprocating pistons 20 and 21 in cylinders 11 and 12. Each piston 20 and 21 is connected to the crankshaft 25 via a con-rod 23 and big end bearings 24. The pistons/cylinders are spaced horizontally as shown in FIG. 2. The face of each cylinder 11 and 12 is closed off by a cylinder head 30 that supports spark plug 31. The space between the interior of the cylinder head 30 and the piston crown 22 defines the combustion chamber 35. Inlet and exhaust valve port 36 and 37 communicate with the combustion chamber 35 along the wall of the cylinders 11 or 12 to constitute a side valve arrangement. Each valve port supports a valve 50 having a head 51 and stem 53. The valve head 51 seals against a valve seat 52 defined by the mouth of the port. The valves are driven by cam followers 42 that directly contact with the lobes 41 of a camshaft 40 that is driven from the crankshaft 25 by a chain, gears or toothed belt.

The opposed cylinders' housings define the central crankcase 13 that is sealed at either end. The crankshaft 25 is mounted for axial rotation about main bearings (not shown) in the crankcase. The crankshaft 25 includes a circular sealing lobe 60 with arcuate cut-outs 61, 62 that open and close an inlet air/fuel passageway 63 via a crankcase inlet port 69 at the top of the crankcase 13 and an exit passageway 65 via a crankcase outlet port 70 at the base of the crankcase 13. The air fuel mixture is derived from suitably positioned fuel injectors 66, 67 at the inlet passage 63 controlled by a conventional throttle 68. The exit passageway 65 feeds the inlet port 36 via a camshaft chamber 39. In the engine described above, the inlet and exhaust valves are controlled through direct contact with the camshaft via cam followers but are closed by a gas drive that is controlled by gas pressure coming from the combustion chamber 35 during the combustion stroke and crankcase during the starting cycle. This arrangement is discussed later in the specification.

In essence the engine operates on a four stroke cycle but utilises crankcase pressure to supercharge each cylinder. The air fuel mixture is pressurised within the crankcase for subsequent transfer to the combustion chamber of each cylinder via the inlet port 36 from the camshaft chamber 39. Side positioned inlet and exhaust valves 50 control the inlet of the air/fuel mixture and exhaust of the exploded gases. These valves, instead of using conventional springs to return to the closed position use a gas drive that's pressure is proportional to the RPM of the engine.

The firing cycle of the engine is now described with reference to nine sheets numbered OP 1 to 4.5. As shown in sheet 1, the pistons are arranged to be in synchronisation, thus both pistons are at top dead centre at the same time.

Alternatively the arrangement could be in 'V' configurations and at top dead centre in the same sector. The air fuel mixture in the left hand cylinder has been compressed and has just been ignited. The right cylinder has just completed the exhaust stroke. At top dead centre the crankcase inlet port 69 is open but the exit port 70 is closed and air fuel mixture is drawn into the crankcase. Thus the crankcase fills with air fuel mixture to atmospheric pressure.

As the pistons move down the cylinder (the 90° position, sheet 1.5) the explosion of the compressed air fuel mixture in the left hand cylinder causes the piston to be driven down the cylinder. The rotating crankshaft in turn draws back the right hand piston. The inlet passageway 63 is closed off by chance by the crankcase inlet port 69 and the crankcase is pressurised causing the air fuel mixture that is contained in the crankcase to be expelled via the crankcase outlet port 70 and exit passageway 65 through camshaft chamber 39 into the combustion chamber of the right hand piston via the inlet port 36 and inlet valve 50 of that cylinder.

As the pistons descend to bottom dead centre, the crankshaft goes through 180°, shown in sheet 2, the combustion stroke of the left hand side has been completed and the exhaust valve is slightly open to allow the piston to again ascend the cylinder. On the right hand side the inlet valve closes and the compression of the air fuel mixture starts.

As the piston returns (see sheet 2.5) on the left hand side the spent mixture is exhausted via the exhaust valve which is now fully open. The crankcase is reopened by rotation of the crank valve drawing in more air fuel mixture as both pistons move up and the right hand piston compresses the air fuel mixture with both inlet and exhaust valves closed.

When the piston reaches top dead centre (shown in sheet 3) the left hand piston/cylinder has completed the exhaust stroke and is ready to draw in fresh mixture and the right hand piston/cylinder is ready for ignition. Air fuel mixture continues to enter the crankcase via the inlet passageway 63. Sheet 3.5 shows the situation where the left hand piston now draws in a fresh charge of pressurised air/fuel taken from the crankcase and transferred via the inlet valve and the right hand piston is now driven down through the explosion of the air fuel mixture by the spark plug. This in turn compresses the crankcase because the crankshaft has now closed the inlet passageway 63 but opened the exit passageway 65.

The next sheet 4 then shows both pistons at bottom dead centre with the left hand piston having fully drawn in the air fuel mixture and the right hand piston having completed the expansion or combustion stroke. At this stage the exhaust valve opens and as shown in sheet 4.5 the left hand piston starts pressurising the gas fuel mixture and the right hand piston exhausts the spent mixture through the exhaust valve at the same time, as both pistons rise, more air fuel mixture is drawn into the crankcase via the inlet passageway 63 to be pressurised as the pistons return. The cycle has then completed 720° (the four stroke engine cycle) so the operation repeats as per the ignition of the left hand piston described on sheet 1.

The opening of the exhaust and inlet valves is carefully controlled through the lobes on the camshaft that act against cam followers. The closing is effected by the gas spring which as described earlier is pressurised by gas pressure taken from the combustion chamber during combustion stroke as well as the crankcase in a starting sequence.

The gas valve spring for each cylinder comprises a valve pressure chamber 80 that slidingly supports valve return pistons 81 and 82 that are attached respectively to the ends of the valve stems 53 of the inlet and exhaust valves 50. As shown in FIG. 2 the valve stems 53 enter the housing 80 in a spaced parallel array and the return pistons 81, 82 form part of the cam followers 42 that are in turn driven open by the lobes 41 of the camshaft 40. Each valve stem 53 extends out of the valve pressure chamber 80 to join the head 51 of the valve which communicates with the combustion chamber 35 through the side mounted inlet and exhaust ports 36 and 37 described above. In one embodiment the valve pressure chamber 80 is pressurised at start up by a source of pressure that comes from the crankcase 13 via a first gallery 88. In start up, one way control ball valve 90 is controlled by a coil spring 92, or reed valve (not shown). Once the engine has started this valve stays closed.

The primary source of gas pressure for the valve pressure chamber 80 comes from a second gallery 89 communicating from the combustion chamber 35 through a valve pressure control assembly 114 to the valve pressure chamber 80. A two-way control ball valve 91 is floating between two sealing seats with combustion pressure on one side and valve pressure on the opposite side. The volume of gas allowed to enter the valve pressure chamber 80 is controlled by a jet 111. Reservoir 113 increases valve pressure volume. This extra volume dampens pressure input pulses and allows for missed firing strokes. The reservoir 113 receives gas from the valve pressure chambers 80. The entries are controlled one way by reed valves 115. The valve pressure chambers 80 are balanced by returning gas from the reservoir 113 through the two-way valves 91. The reservoir 113 can also have a pressure release valve 101 that is controlled by the electronic control unit (ECU) that orchestrates the timing and fuel injection of the engine. In this situation also connected to the reservoir 113 is a pressure sensor 105 that sends a signal to the ECU proportional to the gas pressure. Thus the pressure in the valve pressure chambers 80 and reservoir 113 can be controlled by the ECU.

The gas valve pressure control assemblies 114 also include a third lubricating gallery 110 that communicates between the inlet valve port and the valve stems of both valves to provide a source of cooling and lubrication for the valves by introducing unburnt air fuel mixture to the valve stems. The cross sectional area of the return pistons 81 and 82 are sufficiently great that the force caused by the gas pressure within the pressure housing forces the return pistons to slide towards the camshaft 40 and thus close the valves. In this manner, the valves are closed by gas pressure and not a metal coil spring. The return pistons 81 and 82 require a sealing of cast iron or Teflon™. The ECU can ensure that the pressure and closing force is proportional to the RPM of the engine as can a mechanical control system.

Although the valve pressure chambers are pressurised by the comparatively hot exhaust gases the volume of transfer and size of the second gallery is such that the assembly does not overheat. Furthermore, in one embodiment the valve pressure chambers are surrounded by a water cooled jacket (not shown).

The arrangement described above has a number of advantages. The fact that the pistons rise and fall simultaneously in a horizontally opposed configuration gives optimum balance and does away with the need for separate balance shafts. The rotary valve that is defined by the crankshaft provides a valve of minimum weight and with the least number of components. The rotary valve allows induction and transfer of compressed mixture to the inlet cavity that feeds the combustion chambers of each cylinder via the inlet valves. The fact that the inlet and exhaust valves are side valves is a simpler, lighter and more elegant configuration than overhead valves and is effected by a very small transfer volume with low overall weight. However, it is understood that conventional overhead valve and camshaft configurations and variations on opposing angles can also be used.

The fact that the crankcase is pressurised by an air fuel mixture does away with the need for having a separate sump of oil to lubricate the assembly. Furthermore, a single or double pressure ring can be provided on the piston without the need for lubricating rings. The utilisation of the crankcase pressure has the effect of supercharging the entry of the air fuel mixture and substantially increases the overall efficiency of the engine.

It is understood that the engine could be manufactured in suitable lightweight aluminium and although the preferred embodiment illustrates a two cylinder arrangement, it is understood that these cylinders can be arranged in banks of opposed pairs so that a 2, 4, 6, 8, 10 or 12 cylinder configurations are envisaged depending on the desired power output. It is also understood that the engine could incorporate traditional water cooling passageways with the conventional water cooling radiator and fans. An aircooled engine is also envisaged. The fact that cold air fuel mixture (i.e. vaporised fuel) is drawn into the crankcase means that the crankcase is more cooler than normal thereby reducing the demands on the cooling system. The self-supercharging in low compression side valve configuration of the engine means that there is no need for high quality, high octane fuels with additives such as lead. The engine will operate efficiently on low quality fuels including vegetable oils.

The use of a gas spring to control and close the inlet and exhaust valves is another advantage because the pressure of the gas spring is proportional to the RPM of the engine. Thus, at all times the pressure corresponds to the demands of the engine. This is in contrast with conventional coil springs that are used to close valves. These springs are designed to provide the necessary force for high RPM, thus, at lower revs the springs are far too strong, thus absorbing a considerable amount of power. Springs also have other problems caused with their mass, resulting in valve bounce and other cyclic vibrations that are detrimental to engine performance. The elegance of the gas spring is that the pressure of the system is actually supplied by the combustion pressure produced during the combustion cycle. Furthermore, the gas spring assembly enables the exhaust valve to be opened later due to pressure bleed being required by pressure chambers as engine RPM increases, relieving combustion pressure towards bottom dead centre on the combustion stroke during acceleration. This gives a longer push available on the piston crown. When the engine decelerates, with a closed throttle valve, the engine naturally reduces combustion pressure. Pressure is not available to increase valve spring but is not required and the bleed of pressure from the valve pressure chambers can be reduced via an electronic control valve, controlled by an ECU in conjunction with the fuel injection and ignition systems or its own internal natural bleeding.

However, one problem exists with using gas pressure to close the valves of the engine. At start-up there is no gas to close off the valves, which would mean it would not be possible to pressurise the cylinders. In one embodiment a start cycle is illustrated in the sheet of FIGS. 1 to 3 marked "starting cycle".

The fact that the valves are unsprung means that little power is required to spin the crankshaft and turn over the engine, thus reducing the demands on the starter motor.

After a few initial revolutions driven by the starter motor to prime the engine, the inducted air fuel mixture is compressed in the crankcase and transferred to the camshaft intake cavity through the unsprung intake valves and to the combustion chambers. The crankcase pressure is also transferred via a gallery to the valve pressure chambers through the one way valve 90 in the valve pressure control assembly 114. At this point the pressure in all engine cavities except the exhaust port has been equalised. Intake and exhaust valves now have effective valve timing. Pressure in valve pressure chamber 80 will return the exhaust valve because only ambient pressure exists under the valve head and the intake valve will return because the area of the intake valve head facing the port is less than the return piston surface area.

After valve control is obtained, combustible mixture compressed and ignition has occurred piston is driven down the cylinder and the combustion pressure is fed to the valve chambers via the gallery through the two way valve 91 (reed or ball) for the first time. This raises the pressure in the valve pressure chamber to a level capable of valve control for normal operation and closed one way valves 90 stop escape of pressure to crankcase. At this stage engine assumes the normal operation cycle.

Another option to close the valves for start-up is to couple a small air priming pump to the starter motor that supplies air pressure to the valve chambers to close the valves and allow the engine to start. This arrangement would replace the pressure valves described above.

Although in the preferred embodiment the engine utilises a gas spring to close the inlet and exhaust valves it is understood that the engine could operate with conventional valve springs that close the inlet and exhaust valves. The air fuel mixture may be electronically controlled and the valve timing may be controlled by an electronically adjusted camshaft.

The claims defining the invention are as follows:

1. An internal combustion engine comprising at least one pair of pistons rotating, oscillating or reciprocating in cylinder assemblies joined by a crankcase, each piston being driven by a crankshaft housed in the crankcase, the crankcase including an inlet port for entry of an air fuel mixture and an outlet port for transfer of compressed air fuel mixture, each cylinder having a combustion chamber and at least one inlet and at least one exhaust valve port communicating with the combustion chamber, the inlet valve port being in communication with the crankcase via the crankcase outlet port, the crankshaft including a rotary valve that opens and closes the crankcase inlet and outlet ports as the crankshaft rotates, whereby the engine is adapted to run on a four stroke cycle with the underside of the piston pressurising the air fuel mixture in the crankcase and causing transfer of the pressurised air fuel mixture to the combustion chamber via the crankcase outlet port and inlet valve port.

2. The internal combustion engine according to claim 1, wherein at least two pistons reciprocate in axially opposed cylinders.

3. The internal combustion engine according to claim 1, wherein at least two pistons reciprocate in unison in opposed cylinders in an angled configuration.

4. The internal combustion engine according to claim 1, wherein the interface between each piston and cylinder is a single compression ring.

5. The internal combustion engine according to claim 1 wherein the communication between each valve port and the combustion chamber is closed off by a valve that is driven open by a camshaft.

6. The internal combustion engine according to claim 5, wherein the camshaft is positioned to rotate within a camshaft chamber that is in fluid communication with the inlet valve port of each cylinder and the crankcase via the crankcase outlet port.

7. The internal combustion engine according to claim 1 including means to close the valve in each valve port.

8. The internal combustion engine according to claim 7, wherein the inlet and exhaust valves are closed by a gas spring having a closing force proportional to the speed of the engine.

9. The internal combustion engine according to claim 8, wherein each valve is in communication with a valve pressure chamber, pressurised by gas from the combustion chamber.

10. The internal combustion engine according to claim 9, wherein valve pressure chambers are in fluid communication through fluid control means.

11. The internal combustion engine according to claim 1 wherein the crankcase is cooled by the incoming air fuel mixture.

12. The internal combustion engine according to claim 1 wherein the crankcase is lubricated solely by the air fuel mixture.

* * * * *